United States Patent [19]

Tsukushi et al.

[11] 4,239,948

[45] Dec. 16, 1980

[54] GROUNDED SUPPORT TANK TYPE GAS CIRCUIT BREAKER

[75] Inventors: Masanori Tsukushi; Kunio Hirasawa, both of Hitachi; Katsuichi Kashimura, Takahagi, all of Japan

[73] Assignee: Hitachi, Ltd., Japan

[21] Appl. No.: 707,350

[22] Filed: Jul. 21, 1976

[30] Foreign Application Priority Data

Jul. 30, 1975 [JP] Japan ..... 50-92058

[51] Int. Cl.[3] ..... H01H 33/54

[52] U.S. Cl. ..... 200/148 R; 200/144 AP

[58] Field of Search ..... 200/148 R, 144 AP

[56] References Cited

U.S. PATENT DOCUMENTS 3,745,281 7/1973 Yoshioka ..... 200/148 A 3,983,353 9/1976 Guaglione et al. ..... 200/148 R 4,103,128 7/1978 Kosaku ..... 200/148 B

*Primary Examiner*—Robert S. Macon

*Attorney, Agent, or Firm*—Craig and Antonelli

[57] ABSTRACT

A grounded support tank type gas circuit breaker comprising a cylindrical tank maintained at ground potential and filled with an arc-extinguishing gas, and a breaking unit disposed within the tank with its central axis extending along the axis of the tank. In the circuit breaker, a capacitor unit is disposed within the tank in axially aligned relation with the breaking unit with its axis extending along an extension of the central axis of the breaking unit, so that the capacitor unit can be easily incorporated in the circuit breaker by merely increasing the axial length of the tank.

12 Claims, 11 Drawing Figures

GROUNDED SUPPORT TANK TYPE GAS CIRCUIT BREAKER

BACKGROUND OF THE INVENTION

This invention relates to a grounded support tank type gas circuit breaker comprising a breaking unit disposed within a grounded tank in electrically insulated relation from the tank. More particularly, this invention relates to the arrangement of a capacitor used in conjunction with a circuit breaker of the type above described.

The progressively increasing power demand calls for power transmission lines of larger capacity capable of transmission of higher voltage. Circuit breakers used for the protection of electrical equipments connected to such high-voltage transmission lines are also required to possess a larger capacity capable of breaking high-voltage circuits. A circuit breaker used with such a high-voltage transmission line of increased transmission capacity is required to reliably break the circuit even in such a severe condition as occurrence of a short line fault. An excessively high transient recovery voltage is applied across the contacts of the circuit breaker during interruption of the current flowing through the circuit due to the short line fault. It is commonly known that suppression of the initial rate of rise of the recovery voltage applied across the contacts of the circuit breaker is one of the effective means for improving the breaking capability of the circuit breaker in dealing with the short line fault. As a practical example, such means comprises a capacitor connected between the ground and the line side conductor of the circuit breaker.

A potential divider is required for the purpose of voltage measurement in a substation in which a circuit breaker is disposed. This potential divider is generally disposed independently of the circuit breaker and comprises a primary capacitor connected at one terminal thereof to the line side conductor of the circuit breaker.

As pointed out above, a plurality of capacitors are disposed in the vicinity of a circuit breaker in a substation to make various individual services, and since these capacitors are independent of each other, a plurality of independent support means or containers, for the capacitors are required in the substation. Further, independent spaces are required for the installation of these capacitors.

A grounded support tank type gas circuit breaker is known in the art. This known circuit breaker comprises, within a grounded support tank, a capacitor which is capable of controlling the initial rate of rise of recovery voltage. However, this known grounded support tank type gas circuit breaker has been such that the capacitor is merely disposed within the grounded support tank and is not necessarily located at a most desirable position in the circuit breaker from the structural and operational point of view. More precisely, the capacitor used heretofore for limiting the initial rate of rise of recovery voltage has been disposed in a dead space of the grounded support tank. It has therefore been difficult to find a space for the installation of this capacitor in a grounded tank of a gas circuit breaker of this type which is designed ideally so as not to leave any dead space within the grounded support tank. Thus, an attempt to incorporate this capacitor in the ideal circuit breaker has resulted in the necessity for renewing the design of the grounded support tank.

SUMMARY OF THE INVENTION

It is an object of the present invention to provide a grounded support tank type gas circuit breaker in which any increase in the diameter of the grounded tank is not required and yet a capacitor can be installed in the grounded support tank.

Another object of the present invention is to provide a grounded support tank type gas circuit breaker in which a capacitor for limiting the initial rate of rise of recovery voltage in the event of a short line fault can be installed in the grounded tank without increasing the diameter of the tank.

Still another object of the present invention is to provide a grounded support tank type gas circuit breaker in which a primary capacitor of a coupling capacitor type potential divider can be installed in the grounded tank without increasing the diameter of the tank.

The circuit breaker according to the present invention comprises at least one breaking unit disposed within a grounded cylindrical tank in electrically insulated relation therefrom and having its central axis registered substantially with the central axis of the tank, and a capacitor disposed within the tank to extend along an extension of the central axis of the breaking unit. Thus, the tank may be merely extended in its axial direction, or a new container may be merely added to one of the axial ends of the tank to receive the condenser therein.

DESCRIPTION OF THE PREFERRED EMBODIMENTS

Figure 1:
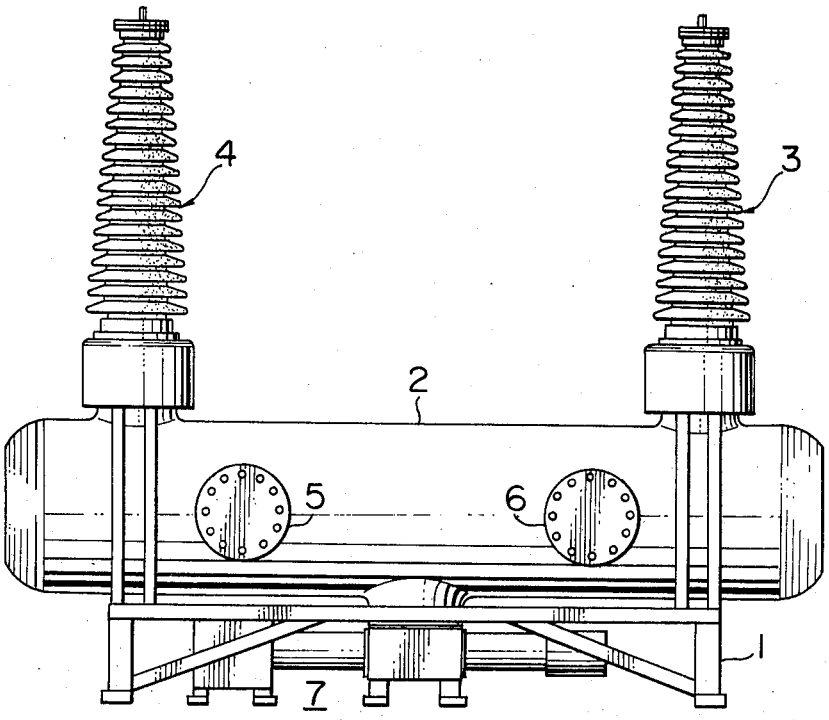
FIG. 1 is a front elevational view of an embodiment of the grounded support tank type gas circuit breaker according to the present invention.

FIG. 1 shows, by way of example, a grounded support tank type gas circuit breaker to which the present invention is applied.

Referring to FIG. 1, a support frame structure 1 is secured to a foundation. A cylindrical tank 2 maintained at ground potential is supported on the support frame structure 1, and a pair of breaking units (not shown) are housed within this tank 2. A pair of bushings 3 and 4 are erected at the axial ends respectively of the tank 2. A plurality of openings are provided in the side wall of the tank 2 and are normally tightly closed by covers 5 and 6 respectively. An actuator 7 is disposed beneath the tank 2 for actuating the breaking units. The breaking units are connected in series with each other between the central conductors extending through the bushings 3 and 4. The internal structure of the tank 2 is shown in detail in FIG. 2 which is a partial sectional view of the left-hand side half of the circuit breaker shown in FIG. 1.

Figure 2:
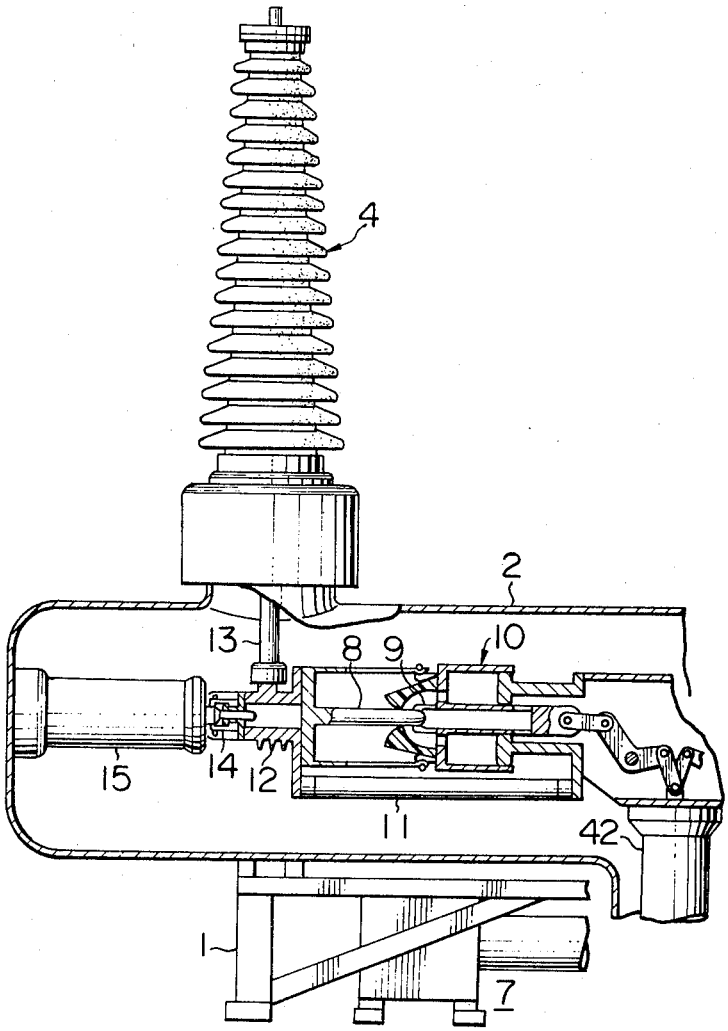
FIG. 2 is a vertical sectional view of part of the grounded support tank type gas circuit breaker shown in FIG. 1.

Referring to FIG. 2, an arc-extinguishing gas such as SF6 gas is filled within the tank 2. Although only one of the series-connected breaking units is shown in FIG. 2, each of these breaking units comprises a stationary contact 8, a movable contact 9, and a puffer device 10. The movable contact 9 illustrated in FIG. 2 is electrically connected to the central conductor 13 of the bushing 4 and is mechanically connected to the actuator 7. In each breaking unit, the puffer device 10 acts to compress the arc-extinguishing gas within the tank 2 in response to the parting of the movable contact 9 from the stationary contact 8, and the gas under high pressure thus obtained is blown toward the arc generating between the stationary and movable contacts 8 and 9 thereby interrupting the current flow. An insulating support means 42 supports the stationary parts of these breaking units and electrically insulates them from the grounded tank 2.

A potential dividing capacitor 11 is connected between the stationary and movable contacts 8 and 9 in electrically parallel relation therewith. This capacitor 11 has a capacitance of the order of $10^2$ pF. The stationary contact 8 which provides the line side conductor of the breaking unit is connected through a conductive member 12 to the central conductor 13 of the bushing 4, and a contact 14 is firmly fixed to the conductive member 12. A capacitor unit 15 is disposed within the tank 2 in the area of the illustrated axial end of the tank 2 and is electrically and mechanically connected at one end thereof to the tank 2. The other end of the capacitor unit 15 is electrically connected to the contact 14. This capacitor unit 15 has a capacity sufficiently large to deal with the recovery voltage, and its capacitance value is selected depending on the number of breaking units, circuit conditions, etc. For example, the capacitance of the capacitor unit 15 is selected to be of the order of 2,000 to 2,500 pF which is about ten times that of the potential dividing capacitor 11.

The capacitor unit 15 is in the form of a ceramic capacitor or oil-filled capacitor, and is received in a hollow cylindrical support member of electrical insulator. The capacitor unit 15 extends on an extension of the central axis of the breaking unit and is thus disposed along the axis of the tank 2. The central axis of the breaking unit registers also with the axis of the tank 2.

In such a circuit breaker structure, the capacitor unit 15 is connected across the line side conductor and ground so as to reliably and sufficiently suppress the recovery voltage applied across the contact members of the breaking unit during current interruption in the event of a short line fault. Therefore, the initial rate of rise of the recovery voltage applied across the contacts of the breaking unit can be limited to a very small value, and the electrical insulation between the contacts can be reliably maintained to attain successful interruption of the current flow. Further, the capacitor unit 15 can be incorporated in the tank 2 by merely increasing the axial length of the tank 2, and any increase in the diameter of the tank 2 is utterly unnecessary. It is needless to mention that the outer diameter of the capacitor unit 15 is limited to a value approximately equal to that of the breaking unit.

Figure 3:
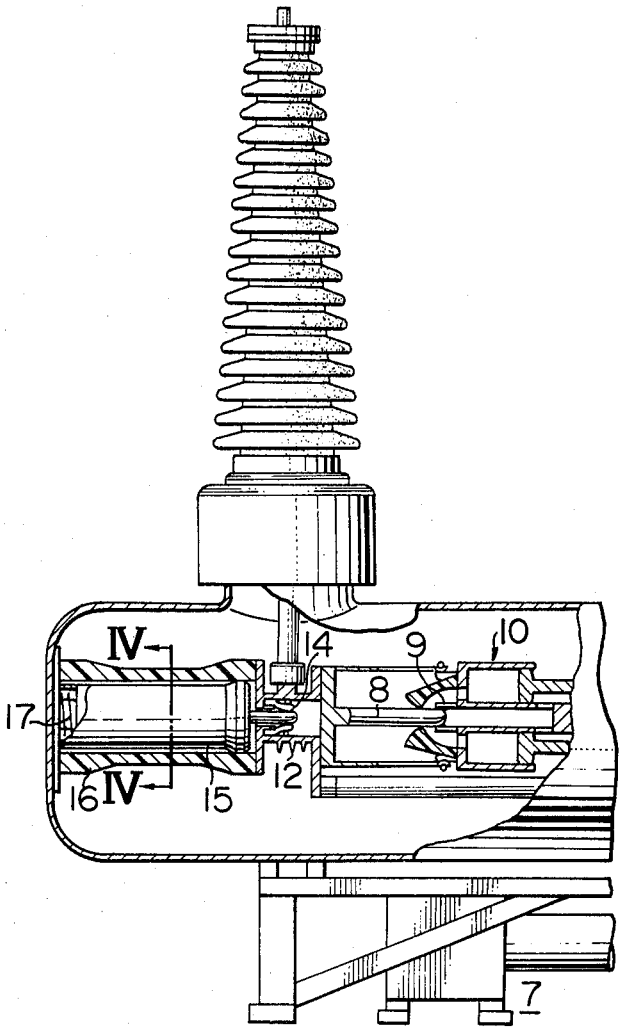
FIG. 3 is a vertical sectional view of part of another embodiment of the present invention.

FIG. 3 shows another embodiment of the present invention, and like reference numerals are used to denote like parts appearing in FIG. 2. Referring to FIG. 3, a hollow cylindrical support member 16 of electrical insulator is secured at one end thereof to the inner wall surface of one of the axial ends of a cylindrical tank 2 which is grounded. The other end of this insulating support member 16 is secured to a conductive member 12. A breaking unit comprises a stationary contact 8, a movable contact 9 and a puffer 10, and the stationary contact 8 is connected to the conductive member 12. Therefore, the stationary contact 8 is firmly supported by the insulating support member 16. A capacitor unit 15 is received in the hollow space of the insulating support member 16 in a manner shown in FIG. 4 which is a sectional view taken along the line IV—IV in FIG. 3. The capacitor unit 15 is electrically connected at one end thereof to the tank 2 and at the other end thereof to the conductive member 12. The internal space of the insulating support member 16 receiving the capacitor unit 15 therein is filled with an arc-extinguishing gas which is the same as that filling the interior of the tank 2. Preferably, the gas space in the tank 2 is partitioned from that in the insulating support member 16 so that the gas puffed for the extinction of the arc may not get into the insulating support member 16.

In the second embodiment too, the central axis of the capacitor unit 15 registers with the axis of the tank 2. Therefore, the capacitor unit 15 can be disposed within the tank 2 by merely increasing the axial length of the tank 2. Further, the mechanical strength of the capacitor unit 15 in the axial direction thereof can be reduced to a value smaller than when the capacitor unit 15 is not received in the insulating support member 16, due to the fact that the capacitor unit 15 is supported by the support member 16 disposed in parallel with the capacitor unit 15. That is, the insulating support member 16 bears the impact that may be imparted to the capacitor unit 15 during the circuit-making engagement between the contacts 8 and 9 in the breaking unit. Additional means may be provided to further enhance this impact alleviating effect. For example, a sliding contact 14 may be used to connect between the capacitor unit 15 and the conductive member 12 so that the impact which may be imparted to the capacitor unit 15 can be adsorbed by the sliding movement of the contact 14. As another example, a spring 17 providing a contact pressure between the elements constituting the capacitor unit 15 may be used to absorb the impact.

Figure 4:
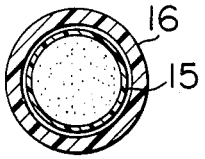
FIG. 4 is a sectional view taken along the line IV—IV in FIG. 3.

FIGS. 5 to 8 show various other forms corresponding to the combination of capacitor unit and insulator shown in FIG. 4. Anyone of these combinations is disposed in the axial direction of the tank 2.

Figure 5:
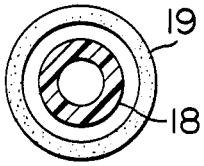
FIGS. 5, 6, 7 and 8 are views similar to FIG. 4, but showing various other preferred forms of the capacitor part shown in FIGS. 3 and 4.

In the form shown in FIG. 5, a cylindrical capacitor unit 19 is disposed outside a hollow cylindrical support member 18 of electrical insulator. In this form, the outer diameter of the insulating support member 18 can be reduced.

Figure 6:
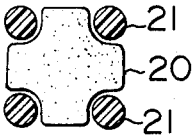

In the form shown in FIG. 6, a plurality of support rods 21 of electrical insulator are disposed around a capacitor unit 20 of plus sign shape. In the forms shown in FIGS. 5 and 6, the capacitor units may be supported directly by the insulating support means which are illustrated as the insulating support cylinder 18 and insulating support rods 21 respectively. In such a case, however, suitable means must be provided to prevent generation of corona discharge at the contact portions between the condenser unit and the insulating support means. For example, in the case of the form shown in FIG. 5, a coating of electrical insulator may be applied to the inner surface of the capacitor unit 19 or spacers of electrical insulator may be interposed between the insulating support member 18 and the electrodes (not shown) of the elements constituting the capacitor unit 19 so as to maintain a uniform gap between the capacitor unit 19 and the insulating support member 18.

Figure 7:
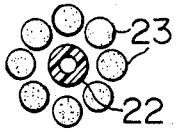

In the form shown in FIG. 7, a capacitor unit consisting of a plurality of rod-shaped capacitors 23 is disposed around an insulating support means 22. These capacitors 23 may be the same as the potential dividing capacitor 11 shown in FIG. 2. In the forms shown in FIGS. 5 to 7, the capacitor units may preferably be housed within simple insulating means or coated with a gas-resisting coating.

Figure 8:
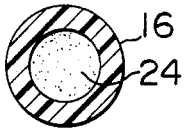

In the form shown in FIG. 8, capacitor elements 24 are housed directly within the hollow cylindrical insulating support member 16 shown in FIG. 3 to provide a capacitor unit. In this case too, the aforementioned means for preventing corona discharge is applied between the inner surface of the insulating support member 16 and the capacitor elements 24.

Figure 9:
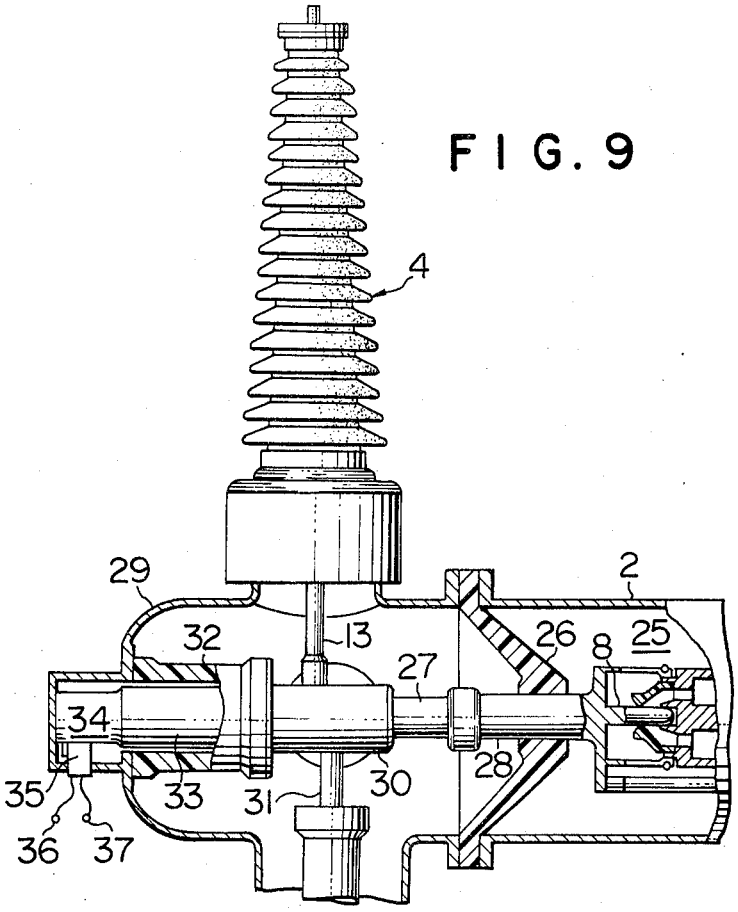
FIG. 9 is a vertical sectional view of part of still another embodiment of the present invention.

FIG. 9 shows still another embodiment of the present invention to illustrate the location of a capacitor unit in a coupling capacitor type potential divider.

Figure 10:
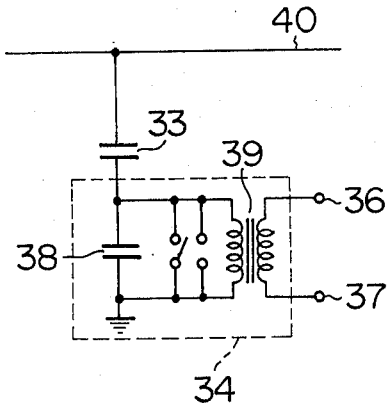
FIG. 10 is a circuit diagram of the potential divider in the circuit breaker shown in FIG. 9.

Referring to FIG. 9, one end of a grounded support tank 2 containing a breaking unit 25 therein is air-tightly sealed by a spacer 26 of electrical insulator. A conductor 28 extends through the center of the insulating spacer 26 to connect a stationary contact 8 of the breaking unit 25 to a stationary member 27 of a disconnecting switch. An additional tank 29 having the same diameter as the tank 2 is disposed at the end of the tank 2, and these two tanks 29 and 2 are firmly bolted together with the insulating spacer 26 interposed therebetween. The disconnecting switch is disposed within the tank 29, and an arc-extinguishing gas is filled in this tank 29 too. A movable member (not shown) of the disconnecting switch is disposed within a shield 30 opposite to the stationary member 27. The movable member of the disconnecting switch is electrically connected to a central conductor 13 of a bushing 4. An actuating rod 31 of electrical insulator is operatively connected to the movable member of the disconnecting switch to urge the same toward and away from and thus in and out of electrical contact with the stationary member 27. The shield 30 is supported by a hollow cylindrical support member 32 of electrical insulator secured at one end thereof to the inner wall surface of the tank 29. A primary capacitor unit 33 similar to the capacitor unit 15 shown in FIG. 3 is received in this insulating support member 32. In FIG. 9, however, this primary capacitor unit 33 is connected electrically at one end thereof to the movable member of the disconnecting switch or to the central conductor 13, and is electrically insulated at the other end thereof from the tank 29. A detector 34 is disposed at the left-hand end of the primary capacitor unit 33, and the primary capacitor unit 33 is mechanically connected to the tank 29 through this detector 34. Output terminals 36 and 37 of the detector 34 are electrically insulated from the tank 29 by an electrical insulator 35 and extend through the electrical insulator 35 to the exterior of the tank 29. The relation between the detector 34 and the primary capacitor unit 33 will be described with reference to a potential divider structure illustrated in FIG. 10. The portion surrounded by the dotted lines in FIG. 10 represents the detector 34. The detector 34 comprises, within a casing of electrical insulator, a secondary capacitor unit 38 connected in series with the primary capacitor unit 33 between a line conductor 40 and the ground, and a potential transformer 39 connected in parallel with the secondary capacitor unit 38. The potential divider having such a structure is used for measuring the voltage of the line conductor 40.

In this third embodiment too, the primary capacitor unit 33 is disposed on an extension of the central axis of the breaking unit 25 so that the primary capacitor unit 33, breaking unit 25 and disconnecting switch align substantially on the same axis. Therefore, the primary capacitor unit 33 can be incorporated in the tank 29 by merely extending the axial length of the tank 29.

Figure 11:
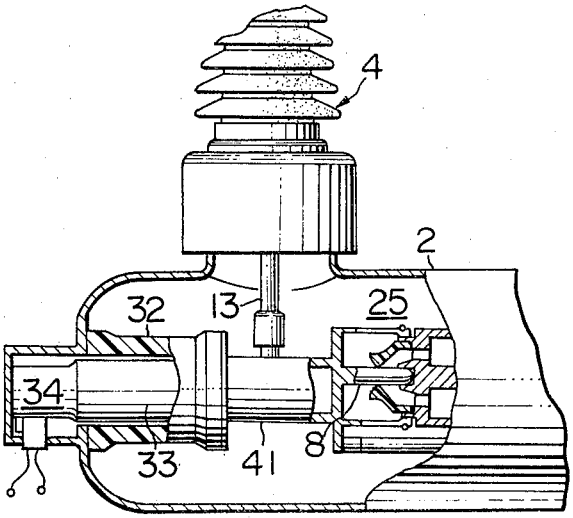
FIG. 11 is a vertical sectional view of part of a modification of the grounded support tank type gas circuit breaker shown in FIG. 9.

FIG. 11 shows a modification of the circuit breaker shown in FIG. 9. In the modification shown in FIG. 11, the potential divider is formed between the disconnecting switch (not shown) and the breaking unit 25. The circuit breaker shown in FIG. 11 differs from that shown in FIG. 9 in that the stationary contact 8 of the breaking unit 25 is connected directly to one end of the primary capacitor unit 33 by a conductive member 41. Thus, any detailed description is unnecessary since the structure of FIG. 11 is the same as that of FIG. 9 except the above difference. In this modification too, the primary capacitor unit 33 is disposed on an extension of the central axis of the breaking unit 25, and the axis thereof aligns substantially with the central axis of the tank 2. Therefore, the primary capacitor unit 33 can be incorporated without increasing the diameter of the tank 2 and by merely increasing the axial length of the existing tank 2.

We claim:

1. A grounded support tank type gas circuit breaker comprising a cylindrical tank maintained at ground potential and filled thereinside with an arc-extinguishing gas, at least one breaking unit disposed within said tank along the axis of said tank, a first support means for supporting said breaking unit in electrically insulated relation from said tank, a capacitor unit disposed within said tank in substantially axially aligned relation with said breaking unit with its axis extending along an extension of the central axis of said breaking unit, said capacitor unit including a plurality of capacitor elements and a hollow cylindrical insulating support member for receiving said capacitor elements therein, a second support means for supporting a line side conductor of said breaking unit in electrically insulated relation from said tank and for receiving impact forces due to a closing operation of the breaking unit, means for electrically connecting one end of said capacitor unit to the line side conductor of said breaking unit while allowing movement of said line side conductor due to said impact forces, and means for mechanically fixedly connecting the other end of said capacitor unit to said tank.

2. A grounded support tank type gas circuit breaker as claimed in claim 1, comprising insulating support means disposed adjacent to said capacitor unit to extend in parallel with said capacitor unit, said insulating support means being firmly connected at one end thereof to the line side conductor of said breaking unit and securely fixed at the other end thereof to the inner wall surface of said tank.

3. A grounded support tank type gas circuit breaker as claimed in claim 2, wherein said insulating support means is a hollow cylindrical support member of electrical insulator, and said capacitor unit is received in said support member.

4. A grounded tank type gas circuit breaker as claimed in claim 1, wherein said capacitor unit electrically connected at one end thereof to the line side conductor of said breaking unit is electrically connected at the other end thereof to said tank.

5. A grounded support tank type gas circuit breaker comprising a cylindrical tank maintained at ground potential and filled thereinside with an arc-extinguishing gas, at least one breaking unit disposed within said tank along the axis of said tank, a first support means for supporting said breaking unit in electrically insulated relation from said tank, a primary capacitor unit disposed within said tank is substantially axially aligned relation with said breaking unit with its axis extending along an extension of the central axis of said breaking unit, said capacitor unit including a plurality of capacitor elements and a hollow cylindrical insulating support member for receiving said capacitor elements therein, a second support means for supporting a line side conductor of said breaking unit in electrically insulated relation from said tank and for receiving impact forces due to a closing operation of said breaking unit, means for electrically connecting one end of said primary capacitor unit to the line side conductor of said breaking unit, and a detector connected mechanically and electrically to the other end of said primary capacitor unit and electrically insulated from said tank, said detector including a secondary capacitor unit connected in series with said primary capacitor unit, and a potential transformer connected in parallel with said secondary capacitor unit.

6. A grounded support tank type gas circuit breaker comprising a cylindrical tank maintained at ground potential and filled thereinside with an arc-extinguishing gas, at least one breaking unit disposed within said tank along with the axis of said tank, a first support means for supporting said breaking unit in electrically insulated relation from said tank, primary capacitor unit means disposed within said tank in substantially axially aligned relation with said breaking unit with its axis extending along an extension of the central axis of said breaking unit for at least limiting the use of recovery voltage in the event of a short line vault without increasing the diametric size of said tank, said capacitor unit means including a plurality of capacitor elements and a hollow cylindrical insulating support member for receiving said capacitor elements therein, a second support means for supporting a line side conductor of said breaking unit in electrically insulated relation from said tank and for receiving impact forces due to a closing operation of said breaking unit, means for electrically connecting one end of said primary capacitor unit means to the line side conductor of said breaking unit, and means for mechanically fixedly connecting the other end of said capacitor unit means to said tank whereby a tank of compact construction is provided.

7. A grounded support tank type gas circuit breaker as described in claim 6, wherein said means for mechanically connecting the other end of said capacitor unit means to said tank comprises:

detector means connected mechanically and electrically to the other end of said primary capacitor unit and electrically insulated from said tank for measuring the voltage of said line conductor.

8. A grounded support tank type gas circuit breaker comprising a cylindrical tank maintained at ground potential and filled thereinside with an arc-extinguishing gas, at least one breaking unit disposed within said tank along the axis of said tank, means for supporting said breaking unit in electrically insulated relation from said tank, primary capacitor unit means disposed within said tank in substantially axially aligned relation with said breaking unit with its axis extending along an extension of the central axis of said breaking unit for at least limiting the use of recovery voltage in the event of a short line fault without increasing the diametric size of said tank, means for electrically connecting one end of said primary capacitor unit means to the line side conductor of said breaking unit and mechanically connecting the other end of said capacitor unit means to said tank whereby a tank of compact construction is provided, wherein said tank comprises a first grounded tank section, an electrical insulator for sealing said breaking unit within said first tank section, and a second grounded tank section in axial alignment with said first tank section and connected thereto with only said electrical insulation interposed therebetween and including said primary capacitor unit means therewithin.

9. A grounded support tank type gas circuit breaker as described in claim 6, further comprising:

disconnecting switch means electrically connected in series connection with said line conductor and breaking unit and operable to disconnect this series connection.

10. A grounded support tank type gas circuit breaker as described in claim 9, wherein said disconnecting switch means comprises:

a stationary member electrically connected to said breaking unit;

a movable member electrically connected to said line conductor and operable to be urged in and out of electrical contact with said stationary member.

11. A grounded support tank type gas circuit breaker comprising a cylindrical tank maintained at ground potential and filled thereinside with an arc-extinguishing gas, at least one breaking unit disposed within said tank along the axis of said tank, means for supporting said breaking unit in electrically insulated relation from said tank, a capacitor unit disposed within said tank in substantially axially aligned relation with said breaking unit with its axis extending along an extension of the central axis of said breaking unit, and means for electrically connecting one end of said capacitor unit to the line side conductor of said breaking unit and mechanically connecting the other end of said capacitor unit to said tank, wherein said means for electrically connecting one end of said capacitor unit to the line side conductor comprises conductive means electrically connected to said line side conductor, and sliding contact means mechanically and electrically connected to one end of said capacitor unit and operable to make slidable electrical contact with said conductive means in order to absorb impacts.

12. A grounded support tank type gas circuit breaker as described in claim 1, wherein said means for mechanically connecting the other end of said capacitor unit to said tank comprises a spring disposed between said tank wall and said other end of said capacitor unit.

* * * * *